United States Patent [19]

Blumhof

[11] Patent Number: 4,807,379

[45] Date of Patent: Feb. 28, 1989

[54] IDENTIFICATION TAG AND METHOD FOR MAKING SAME

[75] Inventor: Roy Blumhof, Arecibo, P.R.

[73] Assignee: Joy Insignia, Inc., Deerfield Beach, Fla.

[21] Appl. No.: 132,900

[22] Filed: Dec. 14, 1987

[51] Int. Cl.[4] ..... G09F 3/20

[52] U.S. Cl. ..... 40/653

[58] Field of Search ..... 40/634, 6, 665, 649, 40/653; 70/457, 456 R; 428/425.1; 112/420, 439, 441; 156/93

[56] References Cited

U.S. PATENT DOCUMENTS

| | | | |
|---|---|---|---|
| 554,171 | 2/1896 | Cushman | 40/653 |
| 973,300 | 10/1910 | Praetz | 40/653 |
| 989,297 | 4/1911 | Schaefer | 40/653 |
| 2,811,797 | 11/1957 | Teetor | 40/665 |
| 4,214,463 | 7/1980 | Blumhof | 70/456 R |

*Primary Examiner*—Robert P. Swiatek
*Assistant Examiner*—Cary E. Stone
*Attorney, Agent, or Firm*—Henry R. Lerner

[57] ABSTRACT

An identification tag for luggage or the like includes a top panel having a predetermined shape with a peripheral edge, opposite inner and outer surfaces, a first aperture adjacent the peripheral edge thereof and a decorative design embroidered on the outer surface; a bottom panel which is the mirror image of the top panel and which is die cut inwardly of its peripheral edges to define a three sided U-shaped flap, and including a second aperture adjacent the peripheral edge thereof in line with the first aperture; the top and bottom panels superimposed on each other in juxtaposed relation such that the bottom panel covers the inner surface of the top panel and substantial portions of the peripheral edges of the superimposed panels are secured to each other by overedge stitching, with other portions of the peripheral edges adjacent the first and second apertures being unattached; an identification card positioned between the top and bottom panels and visually readable when the flap is displaced; and a securing strap extending through the first and second apertures for securing together the unattached portions of the peripheral edges to prevent accidental removal of the identification card from between the top and bottom panels and for securing the identification tag to an object.

12 Claims, 4 Drawing Sheets

FIG. 1
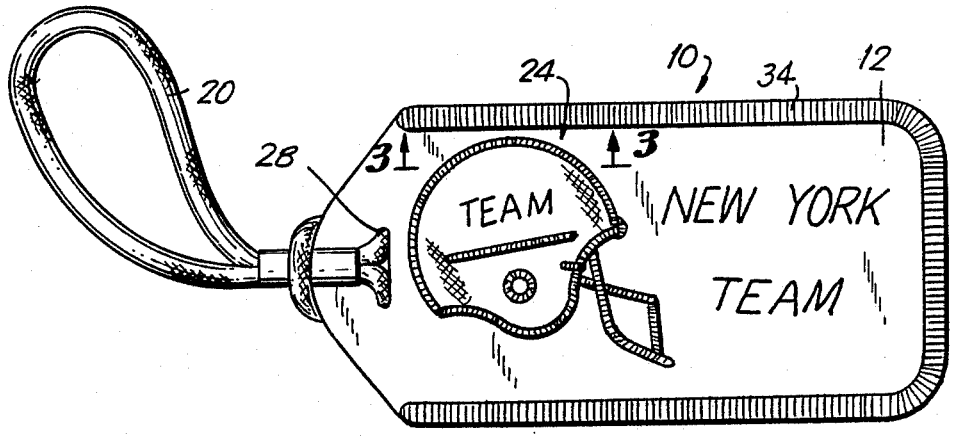
FIG. 2
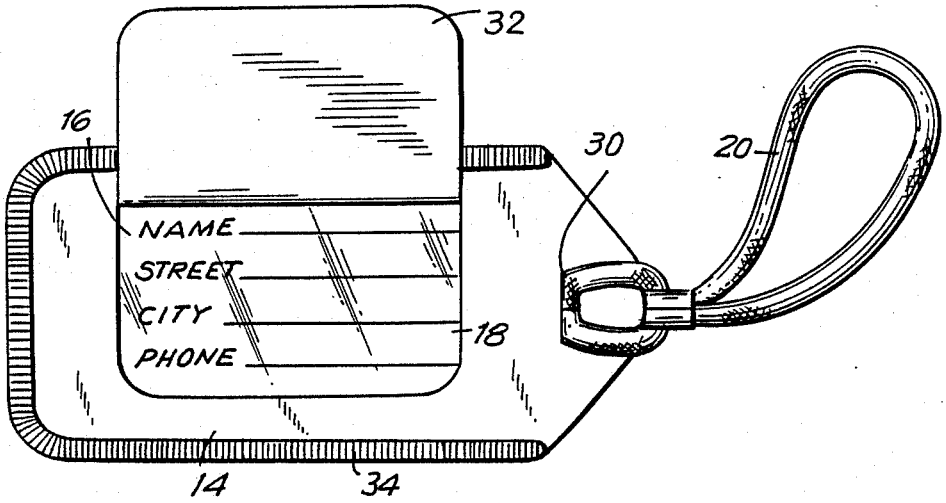
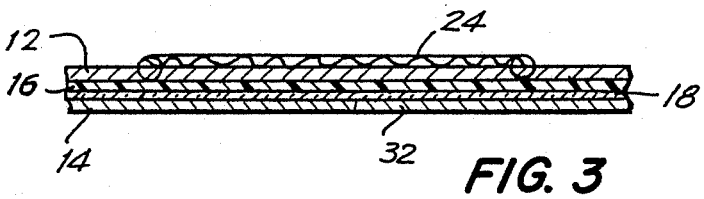
FIG. 3

FIG. 5
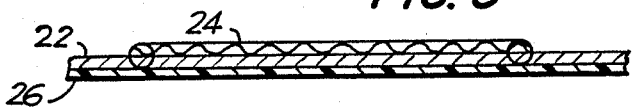
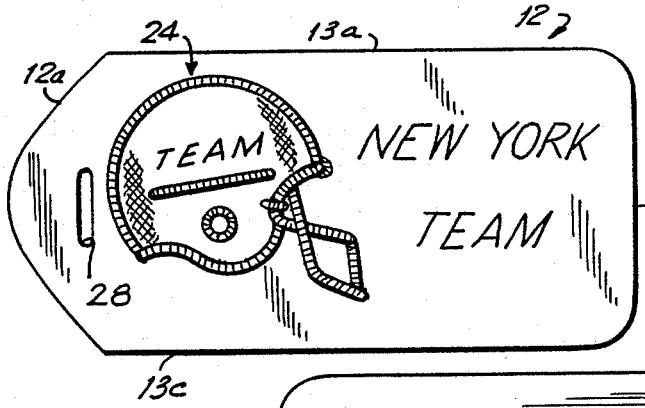
FIG. 6
FIG. 7
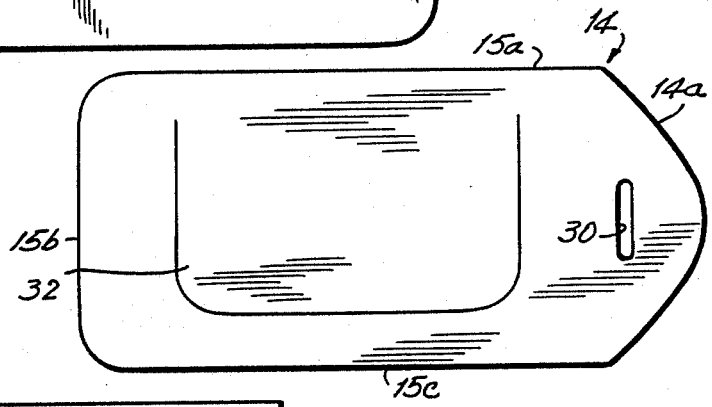
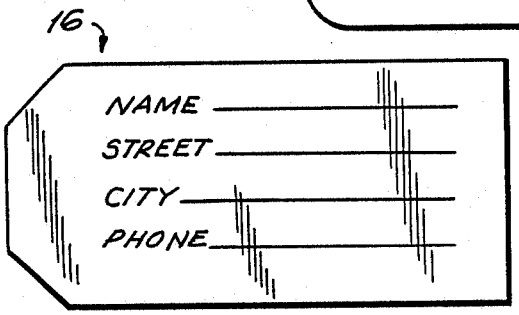
FIG. 8
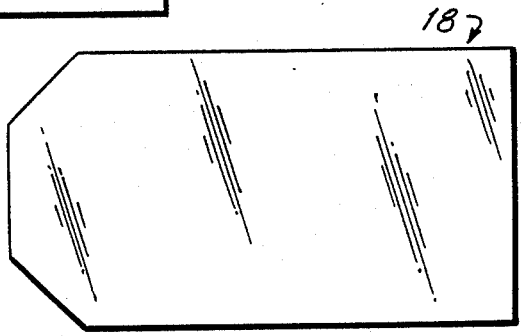
FIG. 9

IDENTIFICATION TAG AND METHOD FOR MAKING SAME

BACKGROUND OF THE INVENTION

This invention relates generally to a novel identification tag and a method for making the same.

Identification tags are most commonly used with luggage and briefcases. Generally, such identification tags include a backing panel having a transparent piece of plastic secured thereto with an opening between the backing panel and plastic to permit an identification card to be inserted into and removed therefrom. In some cases, an additional protective panel is hingedly connected to the first panel so as to cover the transparent plastic sheet. Generally, the backing panel and protective panel are connected at their free ends by a releasable snap arrangement. This construction, however, is relatively complicated and expensive to manufacture.

OBJECTS AND SUMMARY OF THE INVENTION

Accordingly, it is an object of the present invention to provide an identification tag that overcomes the aforementioned disadvantages in the prior art and which incorporates in part the inventions described in my prior U.S. Pat. Nos. 4,149,305 and 4,214,463 which disclose a decorative attachment for a conventional circular key ring. The attachment is formed from a single panel of material which is folded on itself so that the peripheral edges of the folded over portions are in alignment. The key ring is then disposed between the folded over portions at the junction thereof, and the aligned peripheral edges are secured together by an overedging stitch operation, except at the peripheral edges adjacent the key ring. Accordingly, a highly decorative attachment is provided for the key ring, and both are secured together in an inexpensive manner.

It is a further object of the present invention to provide an identification tag which serves as a means for identification and decoration.

It is another object of the present invention to provide an identification tag in which the identification means is protected by and visually accessible through a rear window flap.

It is still another object of the present invention to provide an identification tag in which a securing strap functions to both secure together opposite panels of the identification tag and to releasably prevent escape of the identification card from between the panels.

It is yet another object of the present invention to provide an identification tag that is easy and economical to manufacture and use.

In accordance with an aspect of the present invention, an identification tag includes a top panel having a predetermined shape with a peripheral edge, opposite inner and outer surfaces and a design embroidered on the outer surface; a bottom panel having the mirror image of the top panel; the top and bottom panels superimposed on each other in juxtaposed relation with the juxtaposed panels being secured to each other by overedge stitching along a major portion of the periphery; and securing means for securing the superimposed top and bottom panels to an object.

In accordance with another aspect of the present invention, an identification tag includes a top panel having a predetermined shape with a peripheral edge, opposite inner and outer surfaces and a decorative design embroidered on the outer surface; a bottom panel which is the mirror image of the top panel and which is die cut inwardly of its peripheral edges to define a three sided U-shaped flap; the to and bottom panels superimposed on each other in juxtaposed relation such that the bottom panel covers the inner surface of the top panel and substantial portions of the peripheral edges of the superimposed panels being secured to each other by overedge stitching, with other portions of the peripheral edges being unattached; an identification card positioned between the top and bottom panels and visually readable when the flap is displaced; and strap means for securing together the unattached portions of the peripheral edges to prevent accidental removal of the identification card from between the top and bottom panels and for securing the identification tag to an object.

In accordance with still another aspect of the present invention, a method of producing an identification tag, includes the steps of forming a top panel having a predetermined shape with a peripheral edge and opposite inner and outer surfaces; embroidering a decorative design on the outer surface of the top panel; forming a bottom panel which is the mirror image of the top panel; superimposing the top and bottom panels in juxtaposed relation such that the bottom panel covers the inner surface of the top panel; overedge stitching at least substantial portions of the peripheral edges of the juxtaposed panels to each other; and attaching securing means to the top and bottom panels for securing the identification tag to an object.

In accordance with yet another aspect of the present invention, a method of producing an identification tag includes the steps of forming a top panel having a predetermined shape with a peripheral edge and opposite inner and outer surfaces; embroidering a decorative design on the outer surface of the top panel; forming a bottom panel which is the mirror image of the top panel and which is die cut inwardly of its peripheral edges to define a U-shaped flap; superimposing the top and bottom panels in juxtaposed relation so that the bottom panel covers the inner surface of the top panel; overedge stitching at least substantial portions of the peripheral edges of the juxtaposed panels to each other with other portions of the peripheral edges being unattached; positioning an identification card between the panels such that the identification card is visually readable when the flap is displaced; and attaching securing means to the top and bottom panels for securing the identification tag to an object.

The above and other objects, features and advantages of the present invention will become readily apparent from the following detailed description thereof which is to be read in connection with the accompanying drawings.

BRIEF DESCRIPTION OF THE DRAWINGS

FIG. 1 is a top plan view of the identification tag according to the present invention;

FIG. 2 is a bottom plan view thereof;

FIG. 3 is a cross-sectional view of the identification tag of FIG. 1, taken along line 3—3 thereof;

FIG. 5 is a cross-sectional view of the base material of FIG. 4, taken along line 5—5 thereof;

FIG. 6 is a plan view of a top panel die cut from the base material of FIG. 4;

FIG. 7 is a plan view of a bottom panel die cut from another base material having no patterns embroidered thereon;

FIG. 8 is a plan view of an identification card;

FIG. 9 is a plan view of a clear plastic protective sheet;

DETAILED DESCRIPTION OF THE PREFERRED EMBODIMENTS

Figure 4:
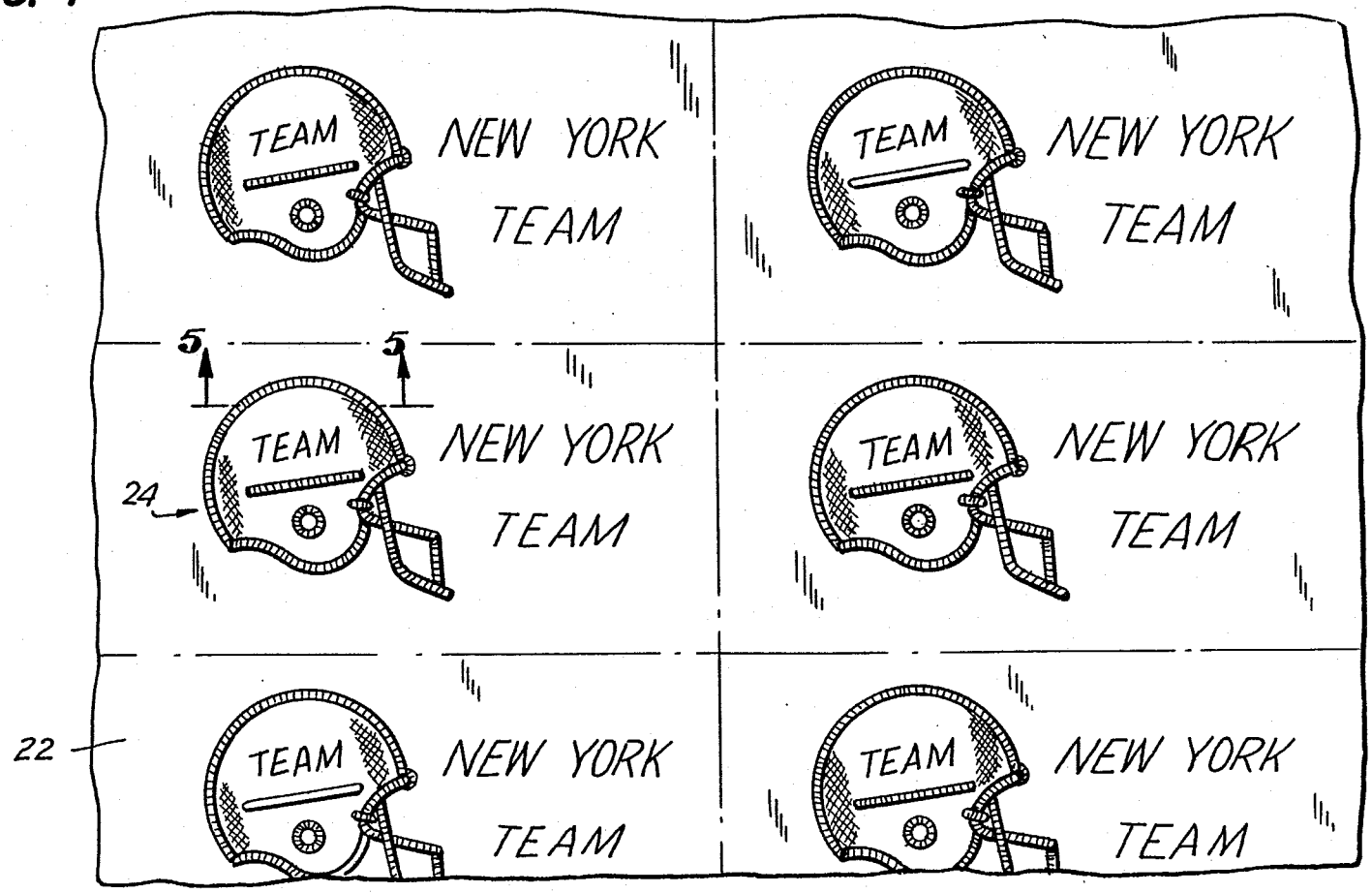
FIG. 4 is a plan view of a base material having a plurality of patterns embroidered thereon in a regular occurring manner.
Figure 10:
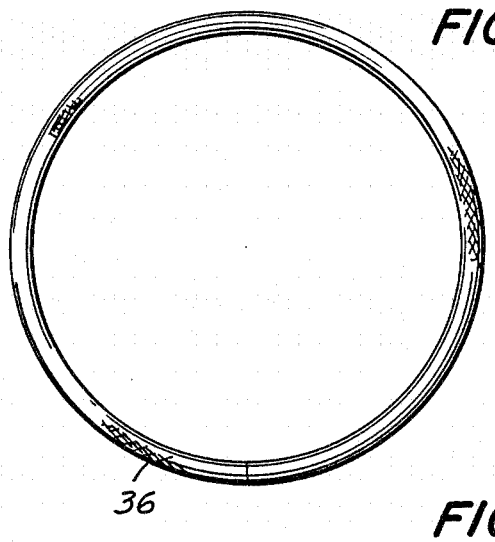
FIG. 10 is a plan view of a securing strap.

Referring to the drawings in detail, and initially to FIGS. 1–14, an identification tag 10 according to the present invention includes an embroidered top panel 12 having a predetermined shape, a bottom panel 14 which is the mirror image of the top panel and is in juxtaposed relation therewith, the panels being secured to each other about a substantial portion of the peripheral edges thereof, an identification card 16 and a transparent plastic sheet 18 inserted through the unattached portions of the peripheral edges of the panels 12 and 14 so as to be positioned therebetween, and a securing strap 20 which secures together the unattached portions of the peripheral edges of panels 12 and 14 to prevent accidental removal of identification card 16 therefrom and for securing identification tag 10 to an object, such as luggage, the cover of a sports racket, a sports bag, a zipper, a school bag, a lunch bag, and the like. Bottom panel 14 is die cut along a U-shaped face to define a flap 32 which is displaceable to expose the identification card 16.

Specifically, referring first to FIGS. 4 and 5, embroidered top panel 12 is formed from a base material 22 which is preferably a cast expanded urethane material supported by a pre-laminated 100 percent cotton drill backing. Preferably, base material 22 is cut into 15 ½ yard lengths and tightened and stretched on a Schiffli embroidery loom. The drill backing prevents the weaker urethane material from ripping during the spanning process and during high speed penetration of the needles on the loom.

While base material 22 is on the loom, various patterns 24 are embroidered thereon in regular spaced intervals. For example, the designs in a preferred embodiment are preferably embroidered in a four and one quarter inch by two inch space. After the embroidering operation, various loose threads are present thereon. The loose thread ends are then vacuumed vertically off the surface of base material 22 and then sheared off by a high speed rotary blade (not shown) in a conventional process known as threadcutting. Thereafter, the 15 ½ yard length of embroidered base material 22 is laminated with a plastic finish 26, such as by heat sealing a .003 mil nylon base laminate to the back surface of embroidered base material 22. This gives body to the embroidered laminated material to facilitate the die cutting operation which follows.

Specifically, embroidered base material 22 having plastic finish 26 thereon is die cut into a predetermined shape, as shown in FIG. 6, to form an embroidered top panel 12 of identification tag 10 having a pattern 24 embroidered thereon. For example, the die cutting operation can be performed by a die cutting machine sold under the name "Hytornic Clicker" using precision steel rule cutting dies. In a preferred embodiment, top panel 12 is formed in a substantially rectangular configuration defined by peripheral edge portions 13*a*, 13*b* and 13*c*, and a V-section 12*a* at the front end thereof. Simultaneously with the cutting of top panel 12 from the embroidered laminated base material, the die cutting machine also cuts and clean strips a small rectangular opening 28 near V-section 12*a* of the cut top panel 12, the reasons for which will be discussed in greater detail hereinafter.

Next, bottom base panel 14, shown in FIG. 7 is die cut in a similar machine from a non-embroidered urethane laminated base material similar to that of FIG. 1 and identical in color, texture and composition therewith. Bottom base panel 14 is the exact mirror image of top panel 12. Bottom panel 14 is also provided with a small rectangular opening 30 at the V-shaped front end 14*a* thereof. In addition, bottom base panel 14 is die cut centrally thereof to form a three-sided U-shaped flap 32, the reason for which will also be explained in greater detail hereinafter.

Thereafter, top panel 12 and bottom panel 14 are superimposed in juxtaposed relation with each other and are permanently bound together by means of an over-edge merrow stitch 34, as shown in FIG. 1, along peripheral edge portions 13*a*, 13*b* and 13*c* of panel 12 and peripheral edge portions 15*a*, 15*b* and 15*c* of bottom panel 14, with the peripheral edges of V-shaped front ends 12*a* and 14*a* being unattached by such stitch. As a result, three sides of panels 12 and 14 are bound together, and the starting and ending points of the overedging are permanently bound as well to prevent unraveling and splitting thereof under normal wear and use.

Identification tag 10 also includes the aforementioned identification card 16, as shown in FIG. 8, which can be constructed from a rigid paper material having printing thereon to impart such information as the name, address and telephone number of the owner. Also, transparent plastic sheet 18, as shown in FIG. 9, is also provided and may be formed from a 10 mil thermoformed plastic material and is used to protect identification card 16. Both identification card 16 and transparent plastic sheet 18 are preferably die cut with a taper at one end thereof to facilitate insertion of the same between the peripheral edges of panels 12 and 14 at V-shaped front ends 12*a* and 14*a* thereof.

Thereafter, an arbitrary cut length of tubular polyester cord 36, preferably 7 millimeters in circumference and pre-died to color match the pattern 24 embroidered on the upper surface of base material 22, is cut. In the preferred embodiment, the length of cord 36 is 245 millimeters, and such cut is made by a metal razor blade connected to a 110 volt power source, thereby generating heat of 350 degrees F. during the cut. Since the cut end is polyester, it is therefore in a molten state for about two to three seconds. Accordingly, within such two to three second elapsed time of cutting and melting, the razor cut ends of cord 36 are held together so that cord 36 is in a circular configuration, as shown in FIG. 7, during the momentary cool down period as to seal the ends together.

Figure 11:
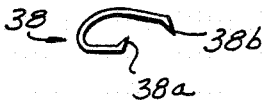
FIG. 11 is an end view of a cord clip for securement around the ends of the securing strap.
Figure 12:
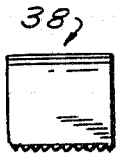
FIG. 12 is a top plan view of the cord clip of FIG. 11.
Figure 13:
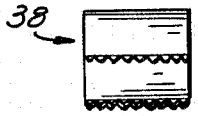
FIG. 13 is a bottom plan view of the cord clip of FIG. 11.
Figure 14:
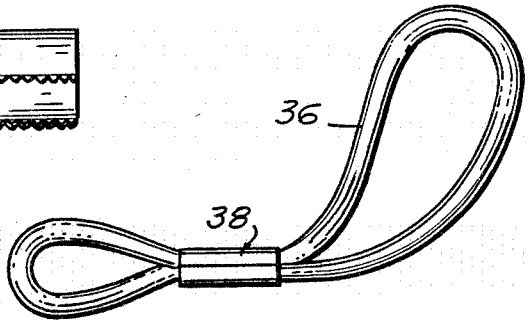
FIG. 14 is a plan view of the securing strap of FIG. 10 with the cord clip of FIGS. 11–13 secured thereto.

In order to further insure that the sealed ends of cord 36 are maintained in a secured relationship, a cord clip 38 formed of a pre-oxidized piece of cast metal is provided. Specifically, cord clip 38 has opposite serrated ends 38*a* and 38*b*, with end 38*a* bent over so as to form cord clip 38 into a substantially J-shape prior to assembly with cord 36, as shown in FIGS. 11–13. To connect cord clip 38 to cord 36, one portion of cord 36 is positioned within the space between serrated ends 38*a* and 38*b* and another portion of cord 36 is positioned adjacent serrated end 38*a* and under end 38*b*. Preferably, the two ends of cord 36 that are joined together are positioned in the space between serrated ends 38*a* and 38*b*. Cord clip 38 is positioned into a machine so that it uniformly closes and locks around double cord 36. In this regard, a male and female closing die are utilized which automatically closes cord clip 38 about double cord 36 so that the operator has both hands free to hold the looped cord in proper position. As a result, there is a uniformity in length of the right and left side loops which is critical to the final stage of assembly. Preferably, the cord is set within cord clip 38 so that one loop to one side of cord clip 38 is approximately 34 millimeters in length and the loop at the opposite side is approximately 70 millimeters in length, as shown in FIG. 11. Thus, the clipped cord forms securing strap 20.

Then, securing strap 20 is fed through openings 28 and 30 in panels 12 and 14 such that the longer of the two loops remains available for securement about the aforementioned object, while the shorter loop is provided to secure cord 36 to identification tag 10. In such case, cord clip 38 provides a lower surface against which the looped end of cord 36 that is secured to identification tag 10 abuts. As a result, securing strap 20 cannot accidentally be removed from identification tag 10.

It will be appreciated that securing strap 20 functions in a two-fold manner, that is, to prevent accidental escape of identification panel 16 from between panels 12 and 14, and to also secure identification tag 10 to an object such as a piece of luggage. Further, identification tag 10 according to the present invention is easy and economical to manufacture and use, while providing an aesthetic appearance with pattern 24 embroidered thereon.

Figure 15:
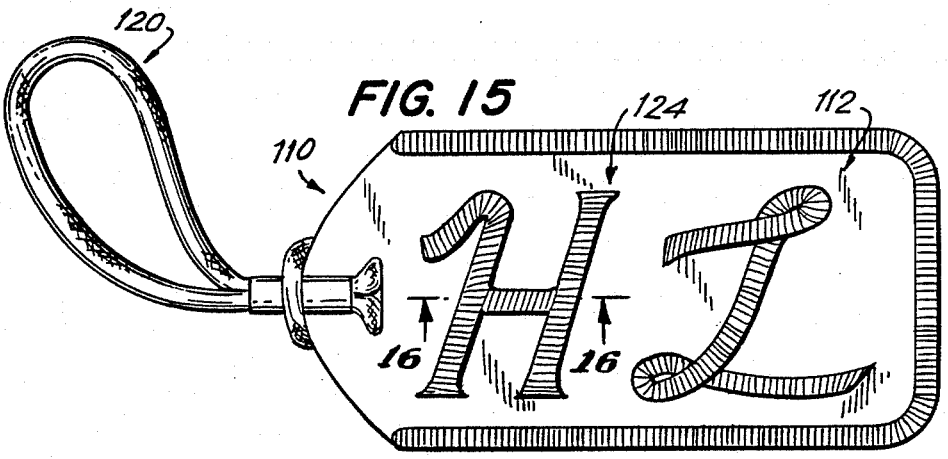
FIG. 15 is a plan view of an identification tag according to another embodiment of the present invention.
Figure 16:
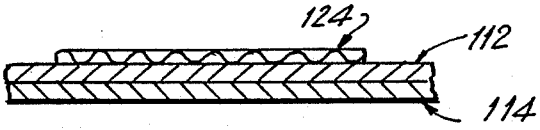
FIG. 16 is a cross-sectional view of the identification tag of FIG. 15, taken along line 16—16 thereof.

Referring now to FIGS. 15 and 16, an identification tag 110 according to another embodiment of the present invention will now be described, in which elements that are similar to those described above with respect to the embodiment of FIGS. 1–14 are identified by the same reference numerals augmented by 100 and a detailed description thereof will be omitted herein for the sake of brevity.

Specifically, identification tag 110 does not include an identification card 16 or a transparent plastic sheet 18. In order to serve as a means of identification, the pattern 124 on the outer surface of top panel 112 itself is the means of identification. For example, such pattern 124 can take the form of the initials or name of the owner.

Having described specific preferred embodiments of the invention with reference to the accompanying drawings, it will be appreciated that various changes and modifications can be made thereto without departing from spirit and scope of the invention as defined by the appended claims.

What is claimed is:

1. An identification tag comprising;

a top panel having a predetermined shape with peripheral edge, opposite inner and outer surfaces and a design embroidered on said outer surface;

a bottom panel which is the mirror image of the top panel;

said top and bottom panels superimposed on each other in juxtaposed relation with the juxtaposed panels being secured to each other by overedge stitching along a major portion of the periphery;

said top panel being formed from a base material which is cast expanded urethane supported by a pre-laminated drill backing; and securing means for securing said superimposed top and bottom panels to an object.

2. An identification tag according to claim 1; wherein said top panel has a substantially rectangular predetermined shape.

3. An identification tag according to claim 1; wherein said top panel has a first aperture, said bottom panel has a second aperture in line with said first aperture when said top and bottom panels are secured together; and said securing means includes strap means connected to said top and bottom panels through said first and second apertures for securing said identification tag to an object.

4. An identification tag comprising;

a top panel having a predetermined shape with a peripheral edge, opposite inner and outer surfaces and a decorative design embroidered on said outer surface;

a bottom panel which is the mirror image of the top panel and which is die cut inwardly of its peripheral edges to define a three-sided U-shaped flap;

said top and bottom panels superimposed on each other in juxtaposed relation such that the bottom panel covers the inner surface of said top panel and substantial portions of said peripheral edges of said superimposed panels being secured to each other by overedge stitching, with other portions of said peripheral edges being unattached;

said top panel being formed from a base material which is cast expanded urethane supported by a pre-laminated drill backing;

an identification card positioned between said top and bottom panels and visually readable when the flap is displaced; and strap means for securing together said unattached portions of said peripheral edges to prevent accidental removal of said identification card from between said top and bottom panels and for securing said identification tag to an object.

5. An identification tag according to claim 4; wherein said top panel includes a first aperture adjacent said unattached peripheral edge thereof, said bottom panel includes a second aperture adjacent said unattached peripheral edge thereof and in line with said first aperture, and said strap means is secured to said top and bottom panels through said first and second apertures.

6. An identification tag according to claim 4; wherein said top panel has a substantially rectangular predetermined shape.

7. An identification tag according to claim 4; further including a transparent protective sheet positioned over said identification card between said top and bottom panels.

8. A method of producing an identification tag, comprising the steps of:

forming a top panel having a predetermined shape with a peripheral edge and opposite inner and outer surfaces;

said top panel being formed from a base material which is cast expanded urethane supported by a pre-laminated drill backing;

embroidering a decorative design on the outer surface of said top panel;

forming a bottom panel which is the mirror image of the top panel;

superimposing said top and bottom panels in juxtaposed relation such that said bottom panel covers the inner surface of said top panel;

overedge stitching at least substantial portions of said peripheral edges of said juxtaposed top and bottom panels to each other; and attaching securing means to said top and bottom panels for securing said identification tag to an object.

9. A method according to claim 8; further including the steps of:

forming a first aperture in said top panel;

forming a second aperture in said top panel which is in line with said first aperture when said top and bottom panels are superimposed on each other;

forming said securing means as strap means; and securing said strap means to said top and bottom panels through said first and second apertures.

10. A method of producing an identification tag, comprising the steps of:

forming a top panel having a predetermined shape with a peripheral edge and opposite inner and outer surfaces;

said top panel being formed from a base material which is cast expanded urethane supported by a pre-laminated drill backing;

embroidering a decorative design on the outer surface of said top panel;

forming a bottom panel which is the mirror image of the top panel and which is die cut inwardly of its peripheral edges to define a U-shaped flap;

superimposing said top and bottom panels in juxtaposed relations so that said bottom panel covers the inner surface of said top panel;

overedge stitching at least substantial portions of said peripheral edges of said juxtaposed panels to each of the with other portions of said pheripheral edges being unattached;

positioning an identification card between said top and bottom panels such that said identification card is visually readable when the flap is displaced; and attaching securing means to said top and bottom panels for securing said identification tag to an object.

11. A method according to claim 10; further including the steps of:

forming a first aperture in said top panel;

forming a second aperture in said bottom panel which is in line with said first aperture when said top and bottom panels are superimposed on each other;

forming said securing means as strap means; and securing said strap means to said top and bottom panels through said first and second apertures.

12. A method according to claim 10; further including the step of positioning a transparent protective sheet over said identification card between said top and bottom panels.

* * * * *